US010927649B2

(12) United States Patent
Barker et al.

(10) Patent No.: US 10,927,649 B2
(45) Date of Patent: Feb. 23, 2021

(54) SYSTEM AND METHOD TO CONTROL WELLBORE PRESSURE DURING PERFORATING

(71) Applicant: Halliburton Energy Services, Inc., Houston, TX (US)

(72) Inventors: James Marshall Barker, Mansfield, TX (US); James Harold Wight, Mansfield, TX (US)

(73) Assignee: Halliburton Energy Service, Inc., Houston, TX (US)

( * ) Notice: Subject to any disclaimer, the term of this patent is extended or adjusted under 35 U.S.C. 154(b) by 303 days.

(21) Appl. No.: 16/084,198

(22) PCT Filed: Apr. 19, 2017

(86) PCT No.: PCT/US2017/028421

§ 371 (c)(1),
(2) Date: Sep. 11, 2018

(87) PCT Pub. No.: WO2018/194595

PCT Pub. Date: Oct. 25, 2018

(65) Prior Publication Data

US 2019/0234162 A1 Aug. 1, 2019

(51) Int. Cl.
*E21B 43/116* (2006.01)
*E21B 43/119* (2006.01)
(Continued)

(52) U.S. Cl.
CPC ..... *E21B 43/116* (2013.01); *E21B 43/1195* (2013.01); *E21B 47/06* (2013.01);
(Continued)

(58) Field of Classification Search
CPC .... E21B 21/08; E21B 43/116; E21B 43/1195; E21B 47/06; E21B 47/007; E21B 33/134; E21B 33/124
See application file for complete search history.

(56) References Cited

U.S. PATENT DOCUMENTS 3,311,178 A * 3/1967 McElheny ..... E21B 43/1195 175/4.54
7,861,784 B2 * 1/2011 Burleson ..... E21B 43/1195 166/297

(Continued)

FOREIGN PATENT DOCUMENTS

WO 2012154180 11/2012
WO 2015060818 4/2015

OTHER PUBLICATIONS

International Search Report and Written Opinion of PCT Application No. PCT/US2017/028421 dated Jan. 16, 2018: pp. 1-18.

*Primary Examiner* — Steven A MacDonald
(74) *Attorney, Agent, or Firm* — Chamberlain Hrdlicka

(57) ABSTRACT

A system and method to control wellbore pressure during perforating. The system comprises a carrier, a sensor, a pressure-altering device, and a processor in communication with the sensor. The sensor is configured to detect a stress wave propagating through the carrier before the arrival of a related pressure wave in the wellbore and generate a signal indicative of the detected stress wave. The pressure-altering device is actuatable to change the pressure in the wellbore. The processor is operable to analyze the signal from the sensor and control the pressure-altering device based on the detected stress wave to change the magnitude of the related pressure wave in the wellbore.

21 Claims, 4 Drawing Sheets

(51) Int. Cl.

| | |
|---|---|
| ***E21B 47/06*** | (2012.01) |
| *E21B 33/124* | (2006.01) |
| *E21B 47/007* | (2012.01) |
| *E21B 33/134* | (2006.01) |

(52) U.S. Cl.
CPC ..... *E21B 33/124* (2013.01); *E21B 33/134* (2013.01); *E21B 47/007* (2020.05)

(56) References Cited

U.S. PATENT DOCUMENTS 8,336,437 B2 * 12/2012 Barlow ..... E21B 43/12 89/1.15
8,985,200 B2 3/2015 Rodgers et al.
9,243,474 B2 * 1/2016 Zhang ..... E21B 43/114
2008/0105430 A1 * 5/2008 Cuthill ..... E21B 43/1195 166/297
2009/0151589 A1 * 6/2009 Henderson ..... E21B 17/07 102/333
2009/0223714 A1 * 9/2009 Hill ..... E21B 43/1195 175/2
2009/0272527 A1 11/2009 Cuthill
2010/0044044 A1 2/2010 Johnson et al.
2011/0067884 A1 3/2011 Burleson et al.
2011/0209871 A1 * 9/2011 Le ..... E21B 43/117 166/297
2012/0152519 A1 * 6/2012 Rodgers ..... E21B 43/119 166/66
2012/0247832 A1 * 10/2012 Cramer ..... E21B 47/017 175/40
2013/0140023 A1 * 6/2013 Baumann ..... E21B 33/1216 166/281
2014/0131097 A1 * 5/2014 Walker ..... E21B 43/116 175/4.51
2014/0260591 A1 * 9/2014 Rodgers ..... E21B 47/017 73/152.58
2016/0047235 A1 * 2/2016 Bondarenko ..... E21B 43/11 175/4.57
2016/0084078 A1 3/2016 Flores et al.
2017/0030186 A1 * 2/2017 Rodgers ..... E21B 49/08

* cited by examiner

SYSTEM AND METHOD TO CONTROL WELLBORE PRESSURE DURING PERFORATING

This section is intended to provide relevant contextual information to facilitate a better understanding of the various aspects of the described embodiments. Accordingly, it should be understood that these statements are to be read in this light and not as admissions of prior art.

A well may be completed and brought into production, in part, by running a perforation gun into the wellbore and firing the perforation gun to create perforation tunnels in the formation. The perforation gun comprises explosive charges which, when ignited, pierce any casing in the wellbore and create the perforation tunnels in the formation surrounding the wellbore. Thereafter hydrocarbons may flow from the formation into the perforation tunnels, into the wellbore, and then rise up the wellbore to be produced at the surface.

When the perforation gun is fired, very high detonation pressures (e.g., several million psi) are initially generated in the wellbore. This initial pressure is transmitted to the surrounding environment, creating strong, transient shock waves that propagate supersonically through adjacent materials (such as fluid in the wellbore and a completion string supporting the perforating gun), eventually attenuating to stress and/or pressure waves traveling at acoustic velocities. The pressure waves can cause damage to downhole equipment, generally manifested as unset packers, corkscrewed tubing, collapsed tools, burst housings, or parted guns. Moreover, the damage to downhole equipment is worsened when two or more pressure waves collide as the local stress and pressure waves are intensified.

Also, the perforating operation may be conducted in an overbalanced pressure condition, wherein the pressure in the wellbore is greater than the pressure in the formation or in an underbalanced pressure condition, wherein the pressure in the wellbore is less than the pressure in the formation. When perforating occurs in an underbalanced pressure condition, formation fluids flow into the wellbore immediately after the wellbore is perforated. This in flow is beneficial as perforating generates debris (such as debris from the casing or cement) that can remain in the perforation tunnels and impair the productivity of the formation. As clean perforations facilitate efficient production of formation fluids, an underbalanced pressure condition can flush the perforation tunnels of debris.

DESCRIPTION OF THE DRAWINGS

For a detailed description of the embodiments, reference will now be made to the accompanying drawings in which.

DETAILED DESCRIPTION

This disclosure describes a perforating completion system. Specifically, the disclosure describes a system and method to alter the wellbore pressure to mitigate the magnitude of a pressure wave induced by a perforating detonation and/or create a underbalanced pressure condition in the wellbore.

Figure 1:
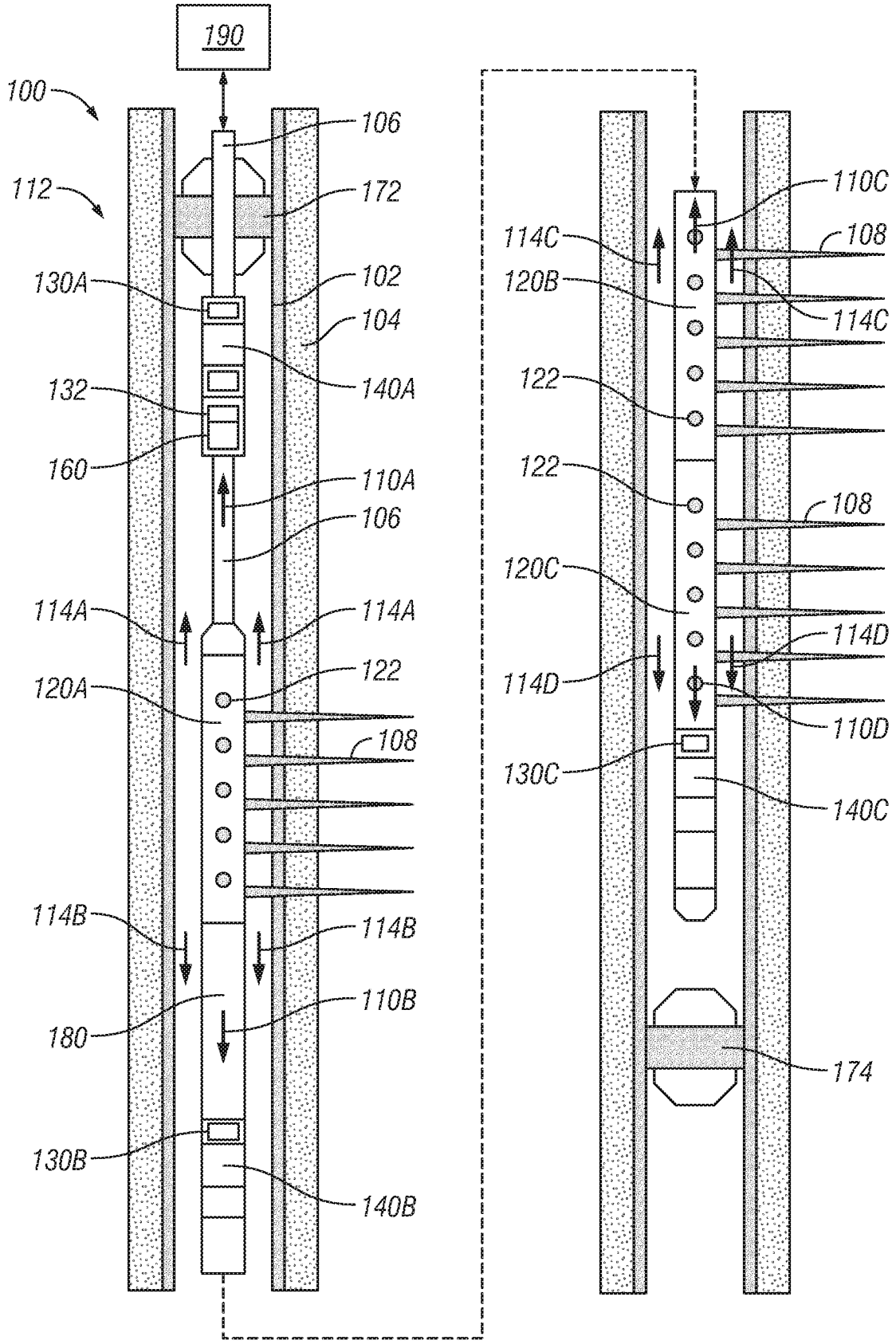
FIG. 1 shows a schematic view of a downhole completion system employed in a wellbore, according to one or more embodiments.

FIG. 1 shows a schematic view of a downhole completion system 100 employed in a wellbore 102 intersecting a subterranean earth formation 104, according to one or more embodiments. As shown, the completion system 100 comprises a work string 106, a perforating gun 120A, a sensor 130A, a pressure-altering device 140A, and a controller 160. Other downhole equipment may be located in the wellbore 102, such as a packer 172 and a detached bridge plug 174. The work string 106 can include a spacer 180, a wireline cable, a slickline cable, coiled tubing, etc. The completion system 100 can also comprise additional perforating guns 120B and C, sensors 130B and C, pressure-altering devices 140B and C as is necessary to control the pressure in the wellbore 102. It should also be appreciated that the completion system 100 is not restricted as to the quantity or location of these components in the wellbore 102.

The perforating gun 120A is run into the wellbore 102 via the work string 106 to perforate the wellbore 102, and where present, a casing and cement layer. Although this discussion is directed to the perforating gun 120A, it is also applicable to the scope of the perforating gun 120B and C as well. The perforating gun 120A comprises explosive charges 122 that are detonated to create perforation tunnels 106 into a formation surrounding the wellbore 102. A detonating cord, for example PRIMACORD® detonating cord available from Ensign-Bickford Aerospace & Defense ("EBAD"), may be employed to convey a controlling ignition to the explosive charges 122 and cause the charges 122 to detonate, perforating the wellbore 102.

The detonation of the explosive charges 122 produces one or more stress wave(s) 110A-D that propagate(s) through a solid carrier 112 (such as the work string 106) and one or more related pressure wave(s) 114A-D that propagate(s) through a fluid (such as drilling fluid) in the wellbore 102. As used herein, the related pressure wave refers to the pressure wave produced in conjunction with a stress wave and propagating in a similar direction as the stress wave. As shown, four pressure waves 114A-D are generated upon the detonation of the explosive charges 122. The detonation of the explosive charges 122 by the perforating gun 120A produces the stress wave 110A and the related pressure wave 114A, which both propagate towards the packer 172. Further, the pressure wave 114A is on a trajectory to impact the packer 172 and can damage the packer 172 if not mitigated. It should be appreciated that the stress waves 110A travels at a higher acoustic velocity through the carrier 112 than the pressure wave 114A travels through the fluid in the wellbore 102. Thus, the stress wave 110A arrives at the sensor 130A before the pressure wave 114A, allowing the controller 160 to determine when to activate the pressure-altering device 140A as further described herein. The detonation of the explosive charges 122 also generates pressure waves 114B and C, which are propagating on a path to collide over the spacer 180, and the pressure wave 114D, which is propagating toward the detached bridge plug 174.

As used herein, the carrier 112 includes any solid material, device, or component through which a stress wave can propagate. As non-limiting examples, the carrier 110 can include the work string 106, the perforating guns 120A-C, downhole equipment (e.g., the packer 172 and the bridge plug 174), the spacer 180, the wellbore 102, casing in the wellbore 102, or the like.

The sensor 130A is configured to detect a stress wave (e.g., the stress wave 110A) propagating through the carrier 112 and generate a signal indicative of the stress wave. Although this discussion is directed to the sensor 130A, it is applicable to the scope of the sensors 130B and C as well. The signal generated by the sensor 130A can represent an intensity of the stress wave as a function of time. The signal can also be used to control the pressure-altering device 140 as further described herein. The sensor 130A can also include axially independent and/or separated sensors to determine a direction of propagation of a stress wave (e.g., the stress wave 110A) propagating through the carrier 112. The sensor 130A may be any suitable sensor for detecting a stress wave, and can include, for example, a piezoelectric sensor, an accelerometer, an electromagnetic acoustic transducer, an optical sensor, an optical fiber sensor, a strain gauge, a load cell, and the like.

A pressure gauge 132 may also be located on the work string 106 to measure a pressure in the wellbore 102. The pressure measurements from the pressure gauge 132 may be used to determine the pressure differential needed to control the pressure in the wellbore 102 with the altering-devices 140A-C as further described herein. For example, the pressure-altering devices 140A-C may be used to create an overbalanced or underbalanced pressure condition in the wellbore 102 based on the pressure measured with the pressure gauge 132.

As explained further below, the pressure-altering device 140A is actuatable to adjust the volume of the wellbore 102 or expand an expandable material and thus change the pressure in the wellbore 102. Although this discussion is directed to the pressure-altering device 140A, it is also applicable to the scope of the pressure-altering devices 140B and C as well. The pressure-altering device 140A can comprise a chamber that can be opened to be in fluid communication with the wellbore 102 and thus increase the volume of the wellbore 102 as further described below with respect to FIGS. 2 and 3. The pressure-altering device 130A can also comprise an expandable material to decrease the volume of the wellbore 102. For example, the pressure-altering device 130A can include a swellable material, an energetic material, or a propellant that increases in volume in the wellbore 102 and thus increases the wellbore pressure. The pressure-altering devices 140A-C can be used to control the pressure in the wellbore to mitigate the intensity of the pressure waves 114A-D to magnitudes below a pressure level that can cause failure of downhole equipment.

The controller 160 controls the one or more pressure-altering devices 140A-C based on a stress wave (e.g., the stress wave 110A) detected by the one or more sensors 130A-C to change the magnitude of a related pressure wave (e.g., the pressure wave 114A) propagating in the wellbore 102 by altering the volume of the wellbore 102. For example, the controller 160 analyzes the signal indicative of the stress wave 110A to determine when to activate the pressure-altering device 140A to mitigate the pressure wave 114A and/or create an underbalanced or overbalanced pressure condition as further described herein with respect to FIG. 4. The controller 160 may also transmit data to a surface controller 190 located at the surface.

The surface controller 190 may be a computer system for processing, monitoring, and controlling the completion of the wellbore 202. Among other things, the computer system may include a processor and a non-transitory machine-readable medium (e.g., ROM, EPROM, EEPROM, flash memory, RAM, a hard drive, a solid state disk, an optical disk, or a combination thereof) capable of executing instructions to perform such tasks. The surface controller 190 may further include a user interface (not shown), e.g., a monitor or printer, to display the status of the completion, such as the measurements taken by the sensors 130A-C. Data may also be transmitted by the surface controller 190, received by the controller 160, and communicated to the perforating guns 120A-C, the sensors 130A-C, and/or the pressure-altering devices 140A-C to control the various components of the downhole completion system 100. For example, the surface controller 190 may trigger the detonation of the perforating guns 120A-C and monitor the operation of the pressure-altering devices 140A-C. It should be appreciated that the completion system 100 is not limited to including the surface controller 190, and the controller 160 may operate in the wellbore 102 independently or autonomously without a surface controller.

Figure 2:
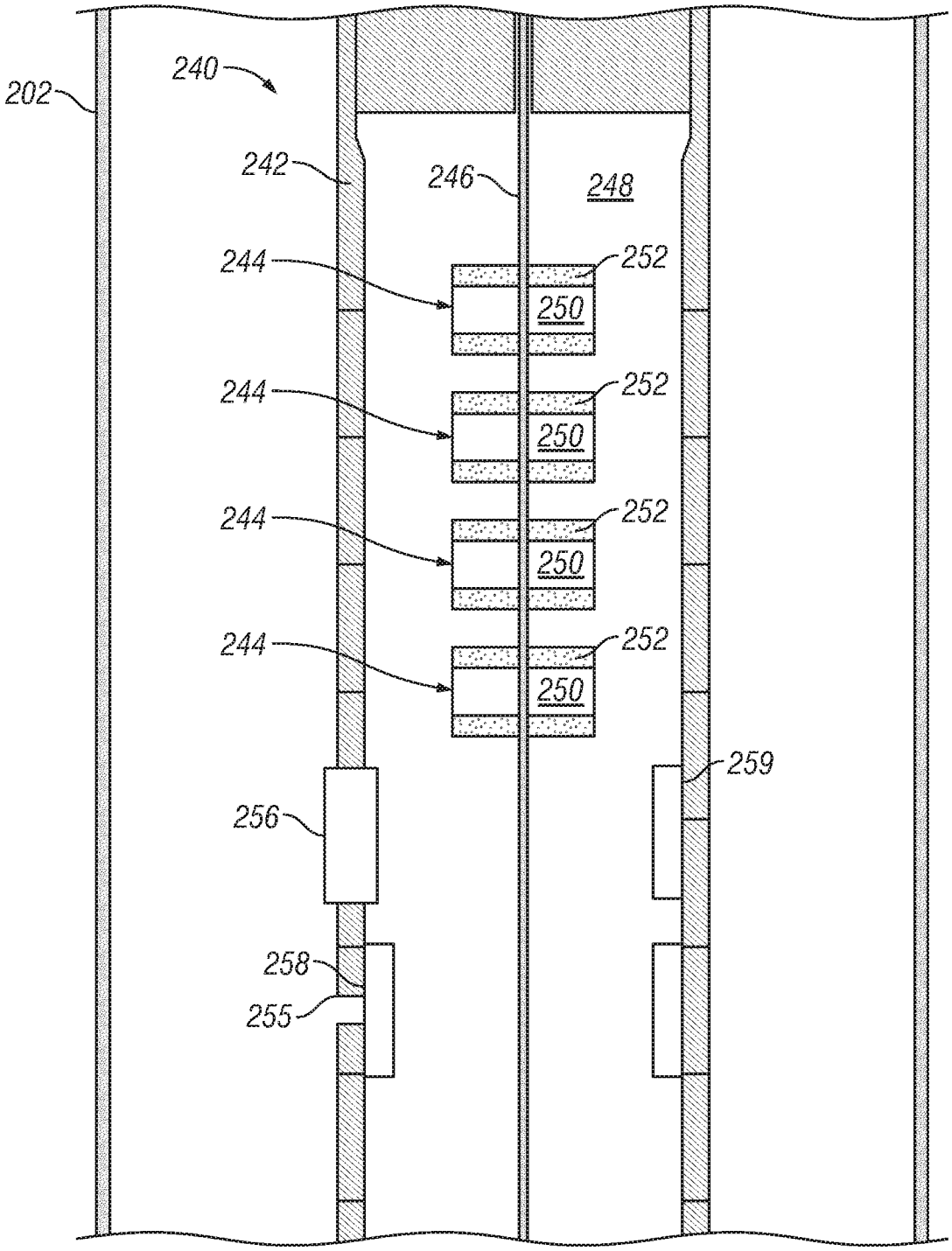
FIG. 2 shows a schematic view of a pressure-altering device, according to one or more embodiments.

FIG. 2 shows a schematic view of a pressure-altering device 240, in accordance with one or more embodiments. As shown, the pressure-altering device 240 comprises a housing 242, vent charges 244, and a detonation cord 246. The interior of the housing 242 includes a chamber 248 that can be opened to be in fluid communication with the wellbore 202 and thus increase the volume of the wellbore 202. The vent charges 244 comprise an explosive material 250 secured in place on the detonation cord 246 by a sleeve 252. The explosive material 250 may include one or more explosive compounds, such as but not limited to cyclotrimethylenetrinitramine (RDX), octogen (HMX), or hexanitrostilbene (FINS). The detonation cord 252 is used to detonate the explosive material 250 to propel a projectile through the housing 242. The projectile perforates the housing 242 and allows the chamber 248 to be in fluid communication with the wellbore 202. The vent charges 244 can be configured to perforate different portions of the housing 242 and/or different surface areas of the housing 242. For example, a vent charge 244 may form a projectile to perforate a larger surface area of the housing 242 than a different vent charge 244.

The chamber 248 can also be pressurized and sealed at a certain pressure to generate an additional pressure wave in the wellbore 202 once the chamber 248 is allowed to be in fluid communication with the wellbore 202. For example, the chamber 248 can be sealed at atmospheric pressure to generate a counterbalancing pressure wave in the wellbore 202 when the chamber 248 is opened to the wellbore 202, allowing a surge of fluid to enter the chamber 248. Alternatively, the chamber 248 can be sealed at a pressure greater than the wellbore pressure at the wellbore depth the pressure-altering device 240 is located, and thus generates a pressure wave that exits the chamber 248, for example to create an overbalanced pressure condition in the wellbore 202. It should be appreciated that the pressure-altering device 240 can include any number of chambers 248 to adjust the volume of the wellbore 202, and that one or more chambers 248 can be pressurized at various pressures to control the amount of pressure change applied to the wellbore 202.

The pressure altering-device 240 may also include other suitable mechanisms to open the chamber 248 to the wellbore 202. As a non-limiting example, the pressure altering-device 240 may include a valve 256 or a sleeve 258 that is actuatable to open the chamber 248 to the wellbore 202. As shown, valve 256 is in a closed position and the sleeve 258 is positioned in the chamber 248 to seal a vent 255. Thus, it should be appreciated that the pressure-altering device 240 is not limited to using a pyrotechnic mechanism, such as the vent charges 244, to open the chamber 248, but may also employ other suitable mechanisms to open the chamber 248.

The pressure altering-device 240 may also include an expandable material 259, including but not limited to a swellable material, an energetic material, or a propellant, that increases in volume in the wellbore 202 and thus increases the wellbore pressure. As a non-limiting example, the expandable material 259 may expand to decrease the volume of the wellbore 202 and create an overbalanced pressure condition in the wellbore 202 and/or intensify the related pressure wave in the wellbore 202. The expandable material 259 may be positioned in the chamber 248 and triggered to increase in volume by opening the chamber 248 to the wellbore 202. As wellbore fluid enters the chamber 248, the expandable material 259 may be exposed to a reactive material in the wellbore fluid or a change in temperature or pressure to trigger the expansion of the expandable material 259.

Figure 3:
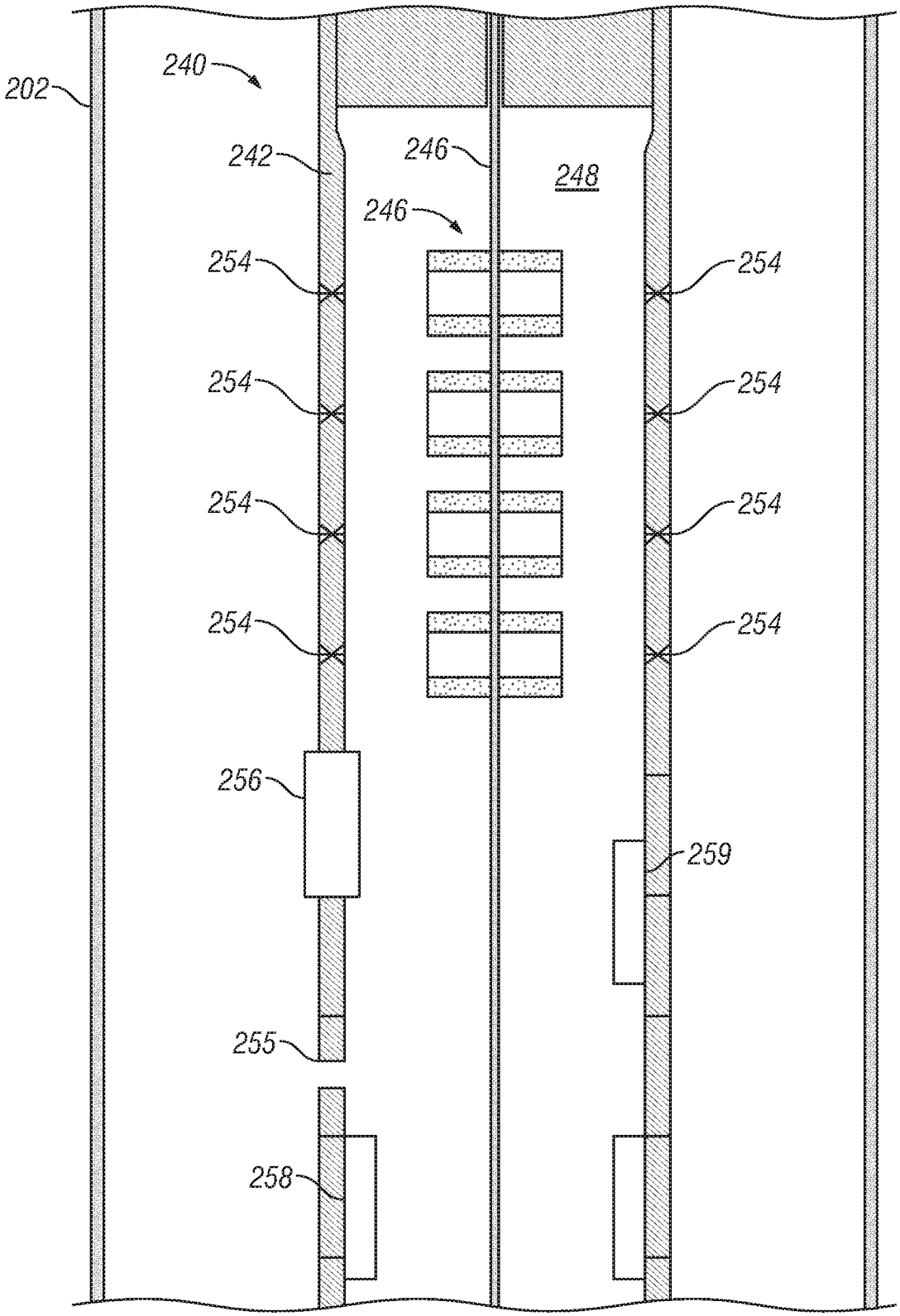
FIG. 3 shows a schematic view of the pressure-altering device of FIG. 2 in fluid communication with a wellbore, according to one or more embodiments.

FIG. 3 shows a schematic view of the pressure-altering device 240 in fluid communication with the wellbore 202, in accordance with one or more embodiments. As shown, the vent charges 244 are detonated forming perforation vents 254 through the housing 242 to allow the chamber 248 to be in fluid communication with the wellbore 202. The quantity and types of vent charges 244 to open different portions of the chamber 248 to the wellbore 202 can be selected and fired as is necessary to mitigate a pressure wave in the wellbore 202 and/or create an overbalanced or underbalanced pressure condition. The valve 256 may be opened to allow the chamber 248 to be in fluid communication with the wellbore 202. The sleeve 258 is also positioned in the chamber 248 to unseal the vent 255 allowing the chamber 248 to be in fluid communication with the wellbore 202.

Figure 4:
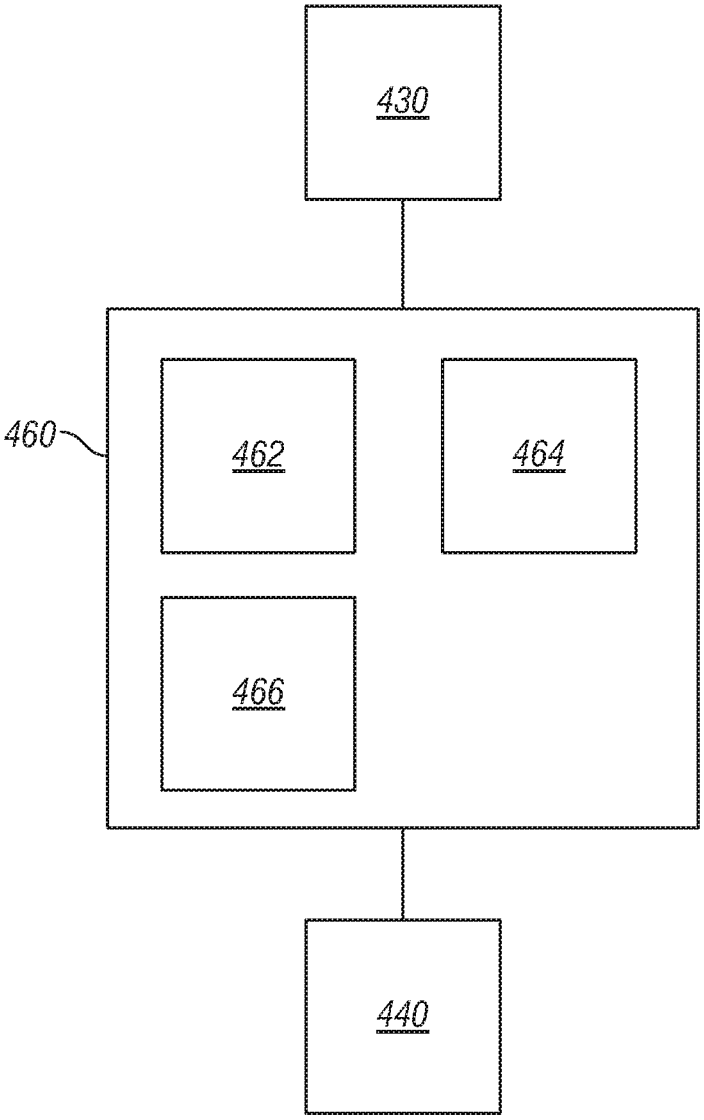
FIG. 4 shows a schematic view of a controller in communication with a sensor and a pressure-altering device, according to one or more embodiments.

FIG. 4 shows a block diagram view of a controller 460 in communication with a sensor 430 and a pressure-altering device 440, in accordance with one or more embodiments. As shown, the controller 460 includes a processor 462, an information storage device 464, and a communication device 466. As used herein, the term processor is intended to include devices such as a field programmable gate array (FPGA).

The processor 462 is configured to analyze a signal indicative of a stress wave (e.g., the stress wave 110A of FIG. 1) generated by the sensor 430. Based on the signal indicative of the stress wave, the processor 462 can determine an arrival time, an acoustic velocity, a direction, and/or a magnitude of the stress wave and the related pressure wave (e.g., the pressure wave 114A of FIG. 1). With an arrival time of the related pressure wave to encounter the pressure-altering device 440, the processor 462 determines when to activate the pressure-altering device 440 to mitigate the magnitude of the pressure wave and the pending impact of the pressure wave upon downhole equipment, such as the packer 172 of FIG. 1. For example, the processor 462 can determine the pending arrival of the pressure wave and rapidly change the pressure along the wellbore using the pressure-altering device 440 before the pressure wave impacts the downhole equipment, such as the packer 172 of FIG. 1. Using the pressure-altering device 440, the pressure wave can be mitigated to a magnitude below a pressure level that can cause failure of downhole equipment, such as the packer of FIG. 1.

The processor 462 can also be configured to determine the amount of wellbore pressure change, based on the signal indicative of the stress wave, needed to mitigate the related pressure wave and/or create an overbalanced or underbalanced pressure condition using the pressure-altering device 440. For example, the processor 462 can analyze the magnitude of the signal indicative of the stress wave to select and open the portions of the pressure-altering device 440 necessary to increase the volume of the wellbore, dampen the related pressure wave, and create an underbalanced pressure condition in the wellbore. The processor 462 can also analyze the magnitude of the signal indicative of the stress wave to select and expand the expandable material or open the portion(s) of the pressure-altering device 440 necessary to decrease the volume of the wellbore and create an overbalanced pressure condition in the wellbore.

It should be appreciated that as well as eliminating the negative effects of pressure waves induced by detonations, the processor 462 can be configured to create a dynamic underbalanced pressure condition in the wellbore using the pressure-altering device 440 to facilitate the clean-up of the perforation tunnels. The sensor 430 may also measure the pressure in the wellbore, which can be used to determine whether to adjust the wellbore pressure with the pressure-altering device 440 to a pressure suitable to clean up the perforations. Perforating generates debris that can remain in the perforation tunnels and impair the productivity of formation fluids. An underbalanced pressure condition can flush the perforation tunnels of debris facilitating clean perforations for efficient production of formation fluids. When perforating occurs in an underbalanced pressure condition, formation fluids flow into the wellbore after the wellbore is perforated and flushes the debris from the perforation tunnels. The processor 462 may analyze the pressure measured by the sensor 430 to determine whether to actuate the pressure-altering device 440 to adjust the wellbore pressure to a pressure suitable to create an underbalanced or overbalanced pressure condition in the wellbore.

The information storage device 464 may include a non-transitory storage medium to electronically store the signals generated by the sensor 430 and/or pressures measured by the sensor 430. The control and processing of the sensor 430 and pressure-altering device 440 is performed with the use of a computer program stored on the storage device 464. The non-transitory storage medium may include ROM, EPROM, EEPROM, flash memory, RAM, a hard drive, a solid state disk, an optical disk, or a combination thereof.

The communication device 466 may be used to receive from or transmit data to various devices of a completion system. Further, the communication device 466 may enable data to be output and/or downloaded in real-time, pseudo real-time, and/or at a later time or date. The communication device 466 may also include a telemetry system to communicate with a surface controller (e.g., the surface controller 190 of FIG. 1). For example, the results of the processing of the signal indicative of the stress wave may be transmitted to the surface controller and output to a suitable medium, such as a display or printer. The communication device 466 may include a direct cable connection device to enable a cable to be input into the communication device 466 to transmit and/or upload data. The communication device 466 may include a wireless communication device, which may include, but is not limited to, an inductive coupling unit, a radio-frequency unit, a radio-frequency identification unit, and/or a suitable wireless communication unit (e.g., ZigBee, Bluetooth, UHF, VHF, Wi-Fi, or the like).

In addition to the embodiments described above, many examples of specific combinations are within the scope of the disclosure, some of which are detailed below:

Example 1

A system for altering pressure in a wellbore intersecting a subterranean earth formation, comprising:

a carrier;

a sensor configured to detect a stress wave propagating through the carrier before the arrival of a related pressure wave in the wellbore and generate a signal indicative of the detected stress wave;

a pressure-altering device actuatable to change the pressure in the wellbore; and a processor in communication with the sensor and operable to analyze the signal from the sensor and control the pressure-altering device based on the detected stress wave to change the magnitude of the related pressure wave in the wellbore.

Example 2

The system of example 1, further comprising a perforating gun configured to detonate a charge in the wellbore to produce the stress wave propagating through the carrier and the related pressure wave propagating in the wellbore.

Example 3

The system of example 1, wherein the pressure-altering device comprises a chamber configured to be opened to be in fluid communication with the wellbore to change the pressure in the wellbore.

Example 4

The system of example 3, wherein the pressure-altering device further comprises any one or combination of a vent charge, a valve, or a sleeve to open a portion of the chamber to the wellbore.

Example 5

The system of example 3, wherein the processor is configured to analyze the signal to determine the amount of wellbore pressure change needed to mitigate the related pressure wave and thus which portions of the chamber to open based on the detected stress wave.

Example 6

The system of example 1, wherein the processor is operable to analyze the signal to determine an arrival time of the related pressure wave in the wellbore based on the detected stress wave.

Example 7

The system of example 1, wherein the pressure-altering device is actuatable to increase the volume of the wellbore to dampen the related pressure wave in the wellbore.

Example 8

The system of example 1, wherein the pressure-altering device is actuatable to decrease the volume of the wellbore to intensify the related pressure wave in the wellbore.

Example 9

The system of example 1, wherein the pressure-altering device comprises a material expandable to increase in volume and increase the wellbore pressure.

Example 10

The system of example 2, wherein the pressure-altering device is actuatable to dampen the related pressure wave in the wellbore before the related pressure wave impacts a downhole tool in the wellbore.

Example 11

A method of altering pressure in a wellbore intersecting a subterranean earth formation, comprising:

creating a stress wave propagating through a carrier and a related pressure wave propagating in the wellbore;

detecting the stress wave propagating through the carrier using a sensor before the arrival of a related pressure wave; and altering the volume of the wellbore or expanding an expandable material in the wellbore based on the detected stress wave using a pressure-alternating device to alter the pressure in the wellbore and thus the magnitude of the related pressure wave.

Example 12

The method of example 11, wherein altering the volume comprises opening a chamber to be in fluid communication with the wellbore to change the pressure in the wellbore.

Example 13

The method of example 12, wherein altering the volume further comprises detonating a vent charge to open the chamber to be in fluid communication with the wellbore.

Example 14

The method of example 11, further comprising detonating a perforating gun in the wellbore to produce the stress wave and the related pressure wave.

Example 15

The method of example 14, wherein altering the volume further comprises dampening the related pressure wave before the related pressure wave impacts a downhole tool located in the wellbore.

Example 16

The method of example 11, further comprising determining an arrival time of the related pressure wave based on the detected stress wave to determine when to alter the pressure in the wellbore.

Example 17

The method of example 11, wherein altering the volume comprises determining the amount of wellbore pressure change needed to mitigate the pressure wave based on the detected stress wave.

Example 18

A tool for altering pressure in a wellbore intersecting a subterranean earth formation, comprising:

a sensor configured to detect a stress wave propagating through a carrier before the arrival of a related pressure wave in the wellbore and generate a signal indicative of the detected stress wave;

a pressure-altering device actuatable to change the pressure in the wellbore; and a processor in communication with the sensor and operable to analyze the signal from sensor and control the pressure-altering device based on the detected stress wave to change the magnitude of the related pressure wave in the wellbore.

Example 19

The tool of example 18, wherein the pressure-altering device further comprises a chamber configured to be opened in fluid communication with the wellbore to change the pressure in the wellbore.

Example 20

The tool of example 19, wherein the pressure-altering device further comprises any one or a combination of a vent charge, a valve, or a sleeve to open a portion of the chamber to the wellbore.

Example 21

The tool of example 19, wherein the pressure-altering device comprises a material expandable to increase in volume and increase the wellbore pressure.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A system for altering pressure in a wellbore intersecting a subterranean earth formation, comprising:

a carrier;

a sensor configured to detect a stress wave propagating through the carrier before the arrival of a related pressure wave in the wellbore and generate a signal indicative of the detected stress wave;

a pressure-altering device actuatable to change the pressure in the wellbore; and a processor in communication with the sensor and operable to analyze the signal from the sensor and control the pressure-altering device based on the detected stress wave to change the magnitude of the related pressure wave in the wellbore.

2. The system of claim 1, further comprising a perforating gun configured to detonate a charge in the wellbore to produce the stress wave propagating through the carrier and the related pressure wave propagating in the wellbore.

3. The system of claim 1, wherein the pressure-altering device comprises a chamber configured to be opened to be in fluid communication with the wellbore to change the pressure in the wellbore.

4. The system of claim 3, wherein the pressure-altering device further comprises any one or combination of a vent charge, a valve, or a sleeve to open a portion of the chamber to the wellbore.

5. The system of claim 3, wherein the processor is configured to analyze the signal to determine the amount of wellbore pressure change needed to mitigate the related pressure wave and thus which portions of the chamber to open based on the detected stress wave.

6. The system of claim 1, wherein the processor is operable to analyze the signal to determine an arrival time of the related pressure wave in the wellbore based on the detected stress wave.

7. The system of claim 1, wherein the pressure-altering device is actuatable to increase the volume of the wellbore to dampen the related pressure wave in the wellbore.

8. The system of claim 1, wherein the pressure-altering device is actuatable to decrease the volume of the wellbore to intensify the related pressure wave in the wellbore.

9. The system of claim 1, wherein the pressure-altering device comprises a material expandable to increase in volume and increase the wellbore pressure.

10. The system of claim 2, wherein the pressure-altering device is actuatable to dampen the related pressure wave in the wellbore before the related pressure wave impacts a downhole tool in the wellbore.

11. A method of altering pressure in a wellbore intersecting a subterranean earth formation, comprising:

creating a stress wave propagating through a carrier and a related pressure wave propagating in the wellbore;

detecting the stress wave propagating through the carrier using a sensor before the arrival of a related pressure wave; and altering the volume of the wellbore or expanding an expandable material in the wellbore based on the detected stress wave using a pressure-alternating device to alter the pressure in the wellbore and thus the magnitude of the related pressure wave.

12. The method of claim 11, wherein altering the volume comprises opening a chamber to be in fluid communication with the wellbore to change the pressure in the wellbore.

13. The method of claim 12, wherein altering the volume further comprises detonating a vent charge to open the chamber to be in fluid communication with the wellbore.

14. The method of claim 11, further comprising detonating a perforating gun in the wellbore to produce the stress wave and the related pressure wave.

15. The method of claim 14, wherein altering the volume further comprises dampening the related pressure wave before the related pressure wave impacts a downhole tool located in the wellbore.

16. The method of claim 11, further comprising determining an arrival time of the related pressure wave based on the detected stress wave to determine when to alter the pressure in the wellbore.

17. The method of claim 11, wherein altering the volume comprises determining the amount of wellbore pressure change needed to mitigate the pressure wave based on the detected stress wave.

18. A tool for altering pressure in a wellbore intersecting a subterranean earth formation, comprising:

a sensor configured to detect a stress wave propagating through a carrier before the arrival of a related pressure wave in the wellbore and generate a signal indicative of the detected stress wave;

a pressure-altering device actuatable to change the pressure in the wellbore; and a processor in communication with the sensor and operable to analyze the signal from sensor and control the pressure-altering device based on the detected stress wave to change the magnitude of the related pressure wave in the wellbore.

19. The tool of claim 18, wherein the pressure-altering device further comprises a chamber configured to be opened in fluid communication with the wellbore to change the pressure in the wellbore.

20. The tool of claim 19, wherein the pressure-altering device further comprises any one or a combination of a vent charge, a valve, or a sleeve to open a portion of the chamber to the wellbore.

21. The tool of claim 19, wherein the pressure-altering device comprises a material expandable to increase in volume and increase the wellbore pressure.

* * * * *